US005795367A

United States Patent [19]

Kennedy et al.

[11] Patent Number: 5,795,367

[45] Date of Patent: Aug. 18, 1998

[54] METHOD OF AND APPARATUS FOR REDUCING SULFUR IN COMBUSTION GASES

[75] Inventors: William R. Kennedy; John M. Kennedy, both of Taylorville, Ill.

[73] Assignee: Jack Kennedy Metal Products & Buildings, Inc., Langleville, Ill.

[21] Appl. No.: 672,341

[22] Filed: Jun. 25, 1996

[51] Int. Cl.[6] ..... B03C 3/013

[52] U.S. Cl. ..... 95/3; 95/13; 95/61; 96/19; 96/27; 110/342; 110/345; 422/186.04; 423/244.05; 431/8

[58] Field of Search ..... 95/3, 13, 58–62; 96/19, 27, 74; 423/244.05; 422/182, 183, 186.04; 110/216, 342, 344, 345; 361/226, 233; 431/4, 5, 8, 268; 55/270, 274; 44/622

[56] References Cited

U.S. PATENT DOCUMENTS

| | | | |
|---|---|---|---|
| 1,413,993 | 4/1922 | Rhodes | 95/61 |
| 4,154,585 | 5/1979 | Melcher et al. | 96/27 |
| 4,185,080 | 1/1980 | Rechmeier | 110/343 X |
| 4,246,245 | 1/1981 | Abrams et al. | 423/243.05 |
| 4,388,283 | 6/1983 | Abrams et al. | 423/244.07 |
| 4,391,207 | 7/1983 | Petersen | 110/342 |
| 4,547,351 | 10/1985 | Im et al. | 95/60 X |
| 4,684,063 | 8/1987 | Goudy, Jr. | 96/27 X |
| 4,710,365 | 12/1987 | Gebhard et al. | 110/345 X |
| 4,861,568 | 8/1989 | Robinson, Jr. | 423/242.5 |
| 4,869,846 | 9/1989 | Mouche et al. | 252/192 |
| 5,058,514 | 10/1991 | Mozes et al. | 423/244.05 X |
| 5,220,875 | 6/1993 | Cox | 431/4 X |
| 5,282,429 | 2/1994 | Kato et al. | 110/344 |
| 5,312,598 | 5/1994 | Kersey et al. | 422/186.04 X |
| 5,332,562 | 7/1994 | Kersey et al. | 95/62 X |
| 5,571,490 | 11/1996 | Bronicki et al. | 423/244.05 X |
| 5,591,412 | 1/1997 | Jones et al. | 422/186.04 X |

*Primary Examiner*—Richard L. Chiesa
*Attorney, Agent, or Firm*—Howell & Haferkamp, L.C.

[57] ABSTRACT

A method for reducing the sulfur content in combustion gases from burning coal includes the steps of applying opposite electrostic charges to fuel particles and to reaction particles, and mixing the oppositely charged particles prior to combustion to facilitate the formation of sulfur compounds from sulfur in the fuel upon combustion of the fuel, to thereby reduce the sulfur content in the combustion gases. The reaction particles are preferably a carbonate such as $CaCO_3$ and $MgCO_3$. The apparatus for implementing the method includes a first pneumatic line for conveying fuel particles, and a first electrostatic charging device for applying an electrostatic charge to the fuel particles conveyed in the line; and a second pneumatic line for conveying carbonate particles, and a second electrostatic charging device for applying an electrostatic charge to the carbonate particles conveyed in the line that is opposite in polarity to the charge applied to the fuel particles. The first pneumatic line and the second outlet line are electrically insulated from each other but outletting to a chamber in sufficiently close proximity to allow the fuel particles and carbonate particles to mix prior to combustion.

12 Claims, 1 Drawing Sheet

METHOD OF AND APPARATUS FOR REDUCING SULFUR IN COMBUSTION GASES

BACKGROUND AND SUMMARY OF THE INVENTION

This invention relates to a method of, and an apparatus for, reducing the sulfur content in combustion gases resulting from the combustion of high-sulfur fuels.

There is currently great emphasis on the reduction of the sulfur compounds in stack emissions, which chiefly appears as $S0_2$. Current attempts to control sulfur content in combustion gases rely primarily on using low sulfur fuels, or pretreating the fuel is some fashion to reduce its sulfur content. Some attempts have been made to control the combustion through the use of fluidized beds to cause the sulfur to formless acidic products.

The method of the present invention provides a way of reducing the sulfur content of combustion gases by facilitating the formation of sulfur compounds and in particular alkalai metal sulfate compounds, such as $CaSO_4$ and $MgSO_4$, near the time of combustion, thereby reducing the amount of sulfur, and in particular $SO_2$ in the combustion gases. Generally, the method of the present invention comprises the steps of applying opposite electrostic charges to coal particles and to reaction particles of substances that react with the sulfur in the coal particles, and mixing the oppositely charged particles prior to combustion of the fuel to facilitate the formation of sulfur compounds from sulfur in the fuel upon combustion of the fuel, to thereby reduce the sulfur content in the combustion gases. The reaction particles are preferably particles of a carbonate, and more preferably an alkalai earth carbonate such as limestone ($CaCO_3$) or an alkalai metal carbonate such as dolomite ($MgCO_3$) or some combination of limestone and dolomite.

The apparatus of the present invention provides the means to carry out this method, and generally comprises a first pneumatic line for conveying coal particles, and a first electrostatic charging device for applying an electrostatic charge to the coal particles conveyed in the line. The apparatus further comprises a second pneumatic line for conveying the reaction particles, and a second electrostatic charging device for applying an electrostatic charge to the reaction particles conveyed in the line that is opposite in polarity to the charge applied to the coal particles. The first pneumatic line and the second pneumatic line are electrically insulated from each other, but outlet in sufficiently close proximity to allow the coal particles and the reaction particles to mix prior to combustion.

The method and apparatus of this invention allow more readily available, less expensive, high-sulfur fuels to be used while still meeting environmental regulations pertaining to sulfur content in combustion gases. No pretreatment of the fuel is required, and therefore no provision need be made for special handling or storage. The amount of carbonate or other reaction particles used can be controlled by monitoring the sulfur content of the combustion gases, and controlling the relative proportions of fuel and carbonate in response to the monitored sulfur content. The electrostatic charges should facilitate the mixing and intimate association of the reaction particles and the coal particles, facilitating the formation of sulfate compounds thereby tying up the sulfur and reducing the amount of sulfur, and in particular $S0_2$, in the combustion gas. The apparatus of is simple construction, and has no moving parts, other than those in the pneumatic conveying system.

These and other features and advantages will be in part apparent and in part pointed out hereinafter.

DETAILED DESCRIPTION OF THE PREFERRED EMBODIMENT

The method of this invention achieves a reduction of sulfur content, and in particular $SO_2$, in combustion gases resulting from the combustion of sulfur-bearing fuels, by facilitating the reaction of the sulfur through the intimate association of the fuel with reaction particles prior to combustion. This association of the fuel with the reaction particles is achieved applying opposite electrostic charges to the fuel particles and to the reaction particles, and mixing the oppositely charged particles prior to combustion. The fuel particles and the reaction particles are conveyed separately in separate conveying systems, and mixed immediately prior to combustion.

In the preferred embodiment the fuel is particles of sulfur-bearing coal, and the reaction particles are limestone ($CaCO_3$) and/or dolomite ($MgCO_3$). Of course, the reaction particles could be some other substances capable of reacting with the sulfur in the coal to form sulfur compounds and thereby remove the sulfur from the flue gases. While the remainder of this description refers to carbonate, it should be understood that the invention is not so limited. The fuel particles and the carbonate particles are separately conveyed in pneumatic conveying systems whose outlets are sufficiently close that upon discharge, the fuel particles and carbonate particles mix and become intimately associated.

According to the method of this invention, the sulfur content of the combustion gases can be monitored, and the relative proportions of fuel and carbonate adjusted in response thereto, to control the sulfur content in the combustion gases.

Figure 1:
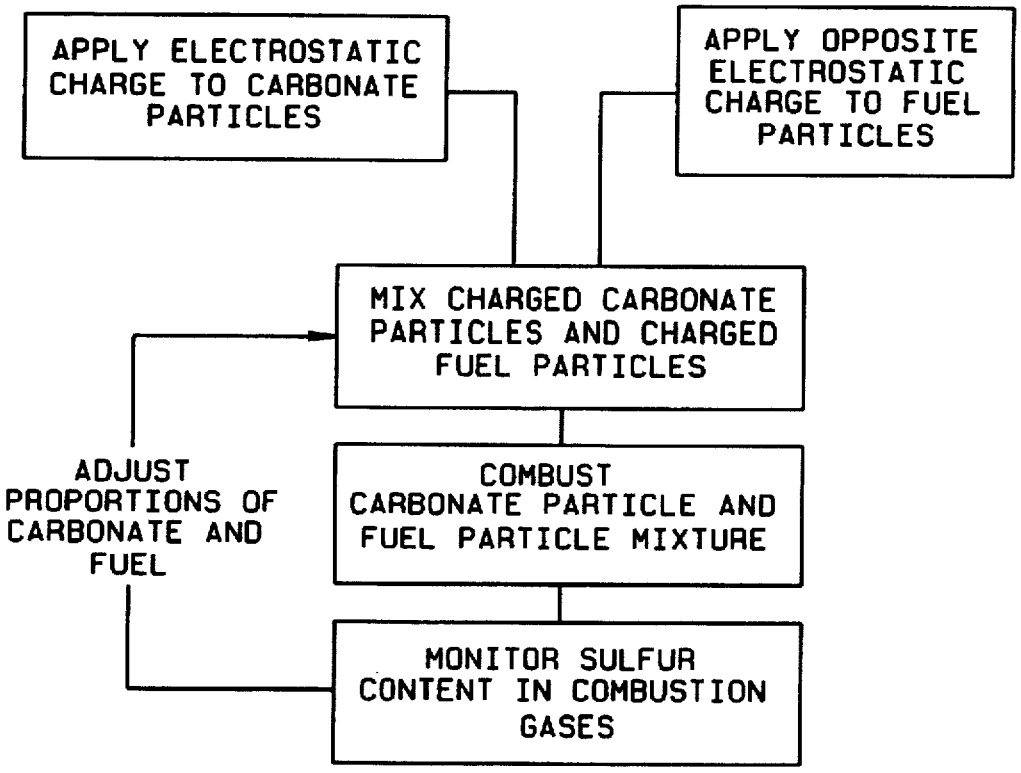
FIG. 1 is a flow chart of the method of this invention.
Figure 2:
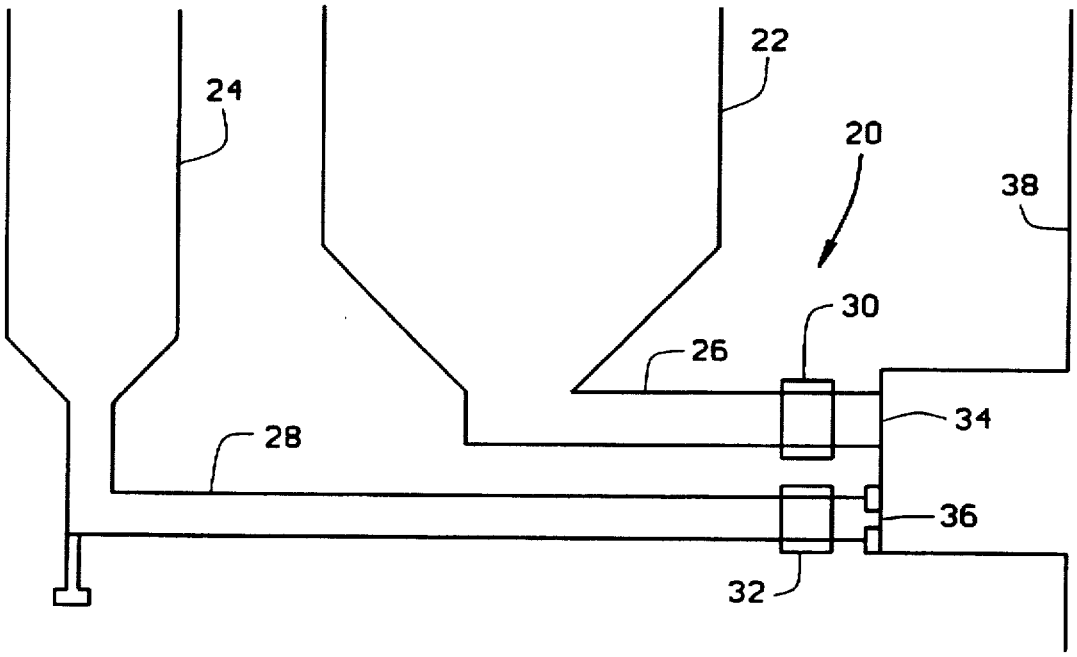
FIG. 2 is a schematic view of the apparatus of this invention for implementing the method.

The apparatus 20 of this invention, shown schematically in FIG. 2, is adapted to implement the method of this invention. As shown in FIG. 2, the apparatus comprises a fuel storage bin 22, for holding crushed coal, and a carbonate storage bin 24, for holding crushed limestone or crushed dolomite, or some mixture thereof. A first conveying system 26, preferably a pneumatic conveying system, conveys fuel particles from the storage bin 22. A second conveying system 28, preferably also a pneumatic conveying system, conveys carbonate particles from the storage bin 24. A first electrostatic charge device 30 applies an electrostatic charge to the fuel particles passing in the conveying system 26. A second electrostatic charge device 32 applies an electrostatic charge to the carbonate particles passing in the second conveying system, applying a charge of opposite polarity from the charge applied to the fuel.

The conveying systems 26 and 28 are separate, and electrically insulated from each other, but preferably have outlets 34 and 36, respectively, which are sufficiently close that the fuel particles and the carbonate particles intermix, and because of the opposite electrostatic charges become intimately associated. Upon subsequent combustion, this intimate association results in sulfur in the fuel being converted into sulfate compounds. In the high temperature environment of the furnace the $CaCO_3$ and $MgCO_3$ react to form CaO and MgO and $CO_2$. The CaO and MgO react with the $H_2SO_4$ in the high temperature environment according to the following reactions $$CaO+H_2SO_4=CaSO_4+H_2O$$

$$MgO+H_2SO_4=MgSO_4+H_2O$$

Thus, much of the sulfur in the fuel is bound in the form of $CaSO_4$ and $MgSO_4$, and is removed from the combustion gases. The formation of the $CaSO_4$ and $MgSO_4$ creates additional material that must be removed from the burner, and results in some dissipation of thermal energy, but this is minimal compared with the benefit of removing sulfur compounds from the combustion gases.

OPERATION

In operation, fuel particles, such as pulverized high sulfur coal, and carbonate particles such as powdered limestone or dolomitic limestone are provided in the storage hoppers 22 and 24, respectively. The fuel particles are conveyed via conveyor 26 to a combustion site, such as a cyclone burner 38, and along the way electrostatic charge device 30 applies a negative charge to the particles. The carbonate particles are conveyed via conveyer to 28 to the cyclone burner, and along the way the electrostatic charge device 32 applies a positive charge to the carbonate particles. As the fuel particles and the carbonate particles exit their respective conveyors into the cyclone burner, they mix. Their opposite electrical charges facilitates the mixing and intimate association of the carbonate particles with the fuel particles. The mixture of particles passes to the actual combustion site in the cyclone burner. The intimate association of the carbonate with the fuel facilitates the conversion of the alkalai metal carbonate to an alkalai metal oxide, and this oxide readily reacts with the $H_2SO_4$ that forms from the combustion of sulfur in the fuel, resulting in the formation of alkalai metal sulfates and water, and reducing the $SO_2$ and $H_2SO_4$ in the combustion gases.

Thus, higher sulfur fuels can be used without need for pretreatment or special storage or handling considerations and sulfur emissions standards can still be met.

As various changes could be made in the above-described methods and processes without departing from the scope of the invention, it is intended that all matter contained in the above description or shown in the accompanying drawings should be determined as illustrative and not in a limiting sense.

What is claimed is:

1. A method for reducing the sulfur content in combustion gases from burning sulfur-bearing fuel, the method comprising the steps of:

applying opposite electrostatic charges to fuel particles and to reaction particles of a substance capable of reacting with the sulfur in the coal to form sulfur compounds, and mixing the oppositely charged particles prior to combustion to facilitate the formation of sulfur compounds from sulfur in the fuel upon combustion of the fuel, to thereby reduce the sulfur content in the combustion gases.

2. The method according to claim 1 wherein the reaction particles are a carbonate.

3. The method according to claim 2 wherein the carbonate is $CaCO_3$ or $MgCO_3$.

4. A method for reducing the sulfur content in combustion gases from burning sulfur-bearing fuel, the method comprising the steps of:

applying opposite electrostatic charges to fuel particles and to carbonate particles, and mixing the oppositely charged particles prior to combustion to facilitate the formation of sulfate compounds from sulfur in the fuel upon combustion of the fuel, to thereby reduce the sulfur content in the combustion gases.

5. The method according to claim 4 wherein a negative charge is applied to the fuel particles, and a positive charge is applied to the carbonate particles.

6. The method according to claim 4 further comprising the step of monitoring the sulfur content of the combustion gases, and increasing or decreasing the relative proportions of the fuel and carbonate particles to maintain the sulfur content of the combustion gases below a predetermined level.

7. A method for reducing the sulfur content in combustion gases from burning sulfur-bearing fuel, the method comprising the steps of:

applying a electrostatic charge to the fuel particles;

applying an opposite electrostatic charge to powdered carbonate;

mixing the electrostatically charged fuel particles and powdered carbonate immediately prior to burning the fuel to facilitate the formation of sulfate compounds from sulfur in the fuel upon combustion of the fuel, to thereby reduce the sulfur content in the combustion gases.

8. The method according to claim 7 wherein a negative charge is applied to the fuel particles, and a positive charge is applied to the carbonate powder.

9. The method according to claim 7 further comprising the step of monitoring the sulfur content of the combustion gases, and increasing or decreasing the relative proportions of the fuel and carbonate to maintain the sulfur content of the combustion gases below a predetermined level.

10. An apparatus for mixing powdered carbonate and sulfurbearing fuel particles prior to combustion to reduce sulfur content in the resulting combustion gases, the apparatus comprising:

a first pneumatic line for conveying fuel particles, and a first electrostatic charging device for applying an electrostatic charge to the fuel particles conveyed in the line; and a second pneumatic line for conveying carbonate powder, and a second electrostatic charging device for applying an electrostatic charge to the carbonate powder conveyed in the line that is opposite in polarity to the charge applied to the fuel particles;

the first pneumatic line and the second pneumatic line being electrically insulated from each other, but outletting to a chamber in sufficiently close proximity to allow the fuel particles and carbonate powder to mix prior to combustion.

11. The apparatus according to claim 10 wherein the first electrostatic charging device applies a negative charge to the fuel particles, and the second electrostatic charging device applies a positive charge to the carbonate powder.

12. The apparatus according to claim 10 further comprising a sensor for sensing the sulfur content in the combustion gases, and a regulator, responsive to the sensor, for regulating the relative proportions of fuel particles and carbonate powder to thereby control the sulfur content in the combustion gases.

* * * * *